United States Patent [19]

Zimmer

[11] 4,216,716

[45] Aug. 12, 1980

[54] APPARATUS FOR SQUEEGEE GUIDANCE IN SCREEN PRINTER

[76] Inventor: Johannes Zimmer, Ebentaler Strasse 133, A-9020 Klagenfurt, Austria

[21] Appl. No.: 923,944

[22] Filed: Jul. 11, 1978

Related U.S. Application Data

[63] Continuation of Ser. No. 721,589, Sep. 8, 1976, abandoned.

[30] Foreign Application Priority Data

Sep. 12, 1975 [AT] Austria ..... 7040/75
May 11, 1976 [AT] Austria ..... 3445/76

[51] Int. Cl.[2] ..... B41F 15/44

[52] U.S. Cl. ..... 101/120; 101/123; 101/124; 118/213

[58] Field of Search ..... 101/119, 120, 122, 123, 101/124, 364; 118/213, 406

[56] References Cited

U.S. PATENT DOCUMENTS

| | | | |
|---|---|---|---|
| 2,922,364 | 1/1960 | Nitchie et al. | 101/364 |
| 3,807,302 | 4/1974 | Kudlich | 101/119 |
| 3,847,076 | 11/1974 | Vasilantone | 101/122 |

FOREIGN PATENT DOCUMENTS

| | | | |
|---|---|---|---|
| 311291 | 11/1973 | Austria | 101/120 |
| 2305443 | 8/1974 | Fed. Rep. of Germany | 101/120 |
| 546145 | 2/1974 | Switzerland | 101/120 |

*Primary Examiner*—E. H. Eickholt
*Attorney, Agent, or Firm*—Haseltine, Lake & Waters

[57] ABSTRACT

The present invention is directed to an apparatus for treating sheet material with liquid substances employing a squeegee for the application of ink or the like onto a sheet material by means of a screen. A side stop arrangement employing sealing plates for cooperating with the squeegee, laterally limits the amount of ink being applied to the material. The stop arrangement has at least one wall portion which is inclined with respect to the direction of motion of the screen and the sealing plate is adjusted so that the bottom surface of the plate is in a portion of an ink pool but spaced from a rotary printing screen so as to form a gap between the bottom surface of the sealing plate and the screen.

8 Claims, 9 Drawing Figures

APPARATUS FOR SQUEEGEE GUIDANCE IN SCREEN PRINTER

This is a continuation of application Ser. No. 721,589 filed Sept. 8, 1976 and now abandoned.

BACKGROUND OF THE INVENTION

The present invention relates to a squeegee device for the treatment of sheet material with liquid, viscous or powdery substances. More particularly the invention is directed at an apparatus for screen printing machines employing a side plate which limits the supply of ink.

The apparatus of the present invention being positioned at each side of a squeegee device, serves the purpose of preventing sideway movement of the ink material to be treated. Particularly when screen printing with rotary screens is involved, the apparatus of the present invention is absolutely necessary, as otherwise the ink or the like, collects in the marginal areas and is taken along by the rotating screen; as a result, coating errors occur because the ink can get behind the squeegee and can also drip off from above.

Equipment which had been used hitherto had a number of disadvantages. Firstly, it was positioned in the coating area and is adjacent to the support or the screen for a distance as far as the ink supply ought to reach. Attachment of prior art equipment was around a point of rotation of a support, this, however, loaded the support with its own weight. Furthermore, movement of the equipment on its support, particularly on rotary screens or on flat screens used with screen printing, entailed a considerable amount of abrasion. Also when rotary screens are used, the screen broke easily. Lastly, the apparatus of the prior art being adjacent to thin-walled rotary screens, can easily damage the latter during insertion and demounting.

SUMMARY OF THE INVENTION

It is an object of the present invention to provide an apparatus by means of which the areas along the sides of a squeegee are kept free from ink without loading the elements therebelow i.e. a screen.

A further object of the invention is to provide an apparatus which should not hinder the adjustments of the squeegee device and of the rotary screen.

According to the present invention a side plate is employed in the form of a sealing plate, being adjustably positioned via a support with respect to the screen, which sealing plate forms a variable gap between the bottom face and the screen.

The stop means apparatus of the invention employs a sealing plate tightly connected to a holding rod for a distance which approximately corresponds to the length of the squeegee. The design of the holding rod supports on the outside of the screen is such that the inventive apparatus can be swivelled by means of the rod as well as moved in the radial and axial directions.

A gap is formed between the underside of the inventive apparatus employing the stop members with sealing plate and the surface of the support. The supports, can be accurately adjusted whereby the inventive stop members together with sealing plate can be moved in a relative position with respect to the squeegee. It follows that the narrow gap formed therebetween does not allow the ink to reach the marginal areas of the rotary screen. Though small amounts of ink penetrate into the gap, it is taken along by the rotating screen or by the driven squeegee. The front portion of the stop members with sealing plate which contacts the ink is bevelled, and is designed in the form of a bevelled shoulder extending outwardly and can be provided with a loosely connected flap member in order to permit re-cycling of the ink. By the inventive apparatus, there is no contact with the inside of the screen, whereby neither the support nor the screen are subjected to wear. Since the inventive apparatus has its underside surface approximately parallel to the surface of the screen, surface pressure is unimportant, so that even when the screen is touched by inadvertence during insertion and demounting, no damage occurs.

A squeegee blade or a squeegee roller can be positioned to cooperate with the inventive structure. The structure employing the sealing plates extends beyond the contact area of the squeegee on the screen and can have a longitudinal surface oriented at least partially inwardly in an inclined manner for the axial guidance of the roller squeegee. The roller squeegee rolls on the inside of the rotary screen can be swivelled to a small extent around a vertical axis. Through such deflection from its normal position with respect to the direction of motion, the roller squeegee is moved in axial direction, i.e. on the side of the rear end of the roller, as viewed from the direction of motion. The roller squeegee rolls up on the inside of the inventive structure employing the sealing plates and the end of the roller is pressed forward by a chamfered inner surface and the squeegee is led back into its starting position. In order to avoid damage to the inventive structure, a thin plate of friction-resistant hard material can be mounted to the inner surface. The inner surface of the traversing stop extends inwardly and is chamfered for at least that portion which is free after the contact with the squeegee.

The invention also contemplates employing the stop member structure where it is inclined to the holding rod, and the total inner surface is positioned in an inclined fashion with respect to the direction of motion.

Other objects and advantages of the present invention will be obvious after considering the specification, claims and drawings.

BRIEF DESCRIPTION OF THE DRAWINGS

The invention is illustrated in more detail hereinafter with reference to the attached drawings, without, however, being limited thereto.

DESCRIPTION OF THE PREFERRED EMBODIMENT

Figure 1:
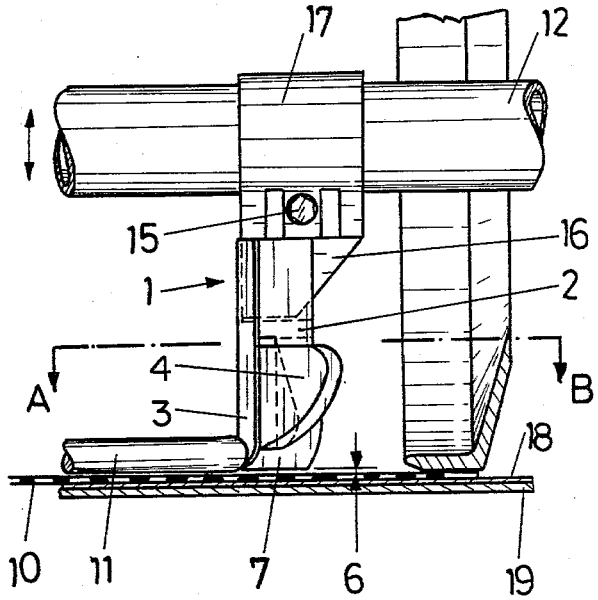
FIG. 1 is a schematic view of a traversing stop in the squeegee axis.
Figure 2:
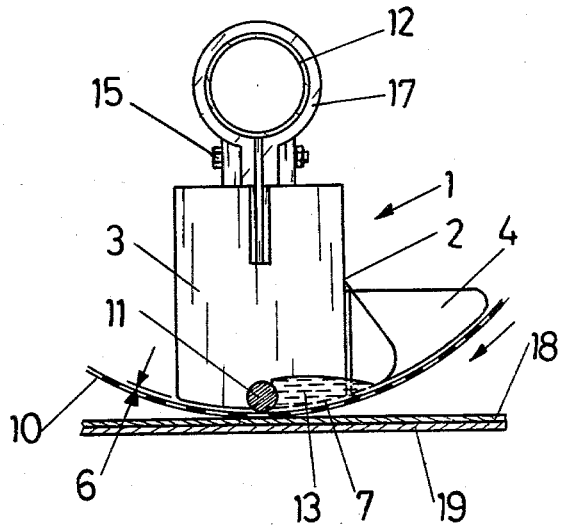
FIG. 2 is another view of FIG. 1 in the direction of the squeegee axis.
Figure 3:
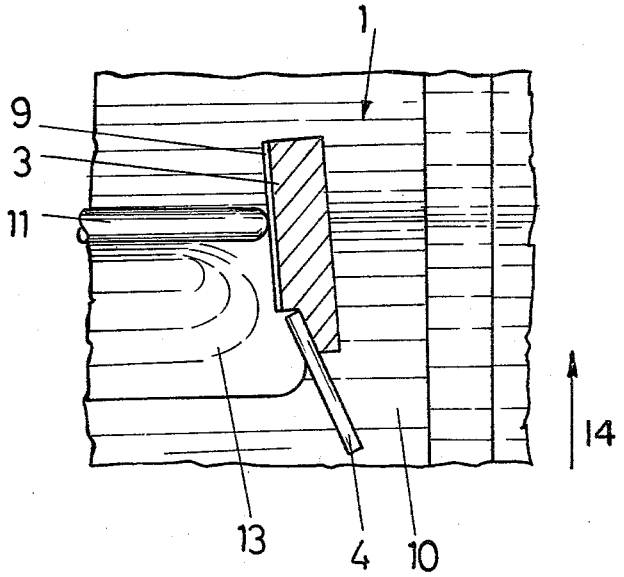
FIG. 3 is a section on the line AB in FIG. 1.

The sealing plate 1 according to FIGS. 1–3 is attached to the holding rod 12 by means of a clamp strip 17 via a projecting chamfered sheet metal member 16 and a clamping screw 15. Through this arrangement, the inner surface 3 of the sealing plate 1 is inclined with respect to the direction of motion 14 and serves to guide roller squeegee 11. A plate 9 of friction-resistant hard material is inserted to prevent damage to the sealing plate 1. The surface of the underside 7 is at least approximately parallel to that of rotary screen 10. The sealing plate 1 is adjusted via holding rod 12 for a distance with respect to the screen, such that a narrow gap 6 is formed. The distance, however, does not allow an emergence of the ink into the marginal areas of the rotary screen 10 and may for instance be 0.5 mm. The ink 13 which penetrates into the gap 6 is taken along in the direction 14 by the movement of rotary screen 10, and is fed back to the ink supply 13 located between the two traversing stops by the flap 4 which is swivellingly connected to the chamfered width 2 of the sealing plate 1. The squeegee 11 applied the ink 13 through the rotary screen 10 onto the sheet of material 18 which is attached to printer's blanket 19. The process of application of pressure by the squeegee is not shown since the use of the sealing plate is independent thereof.

Figure 4:
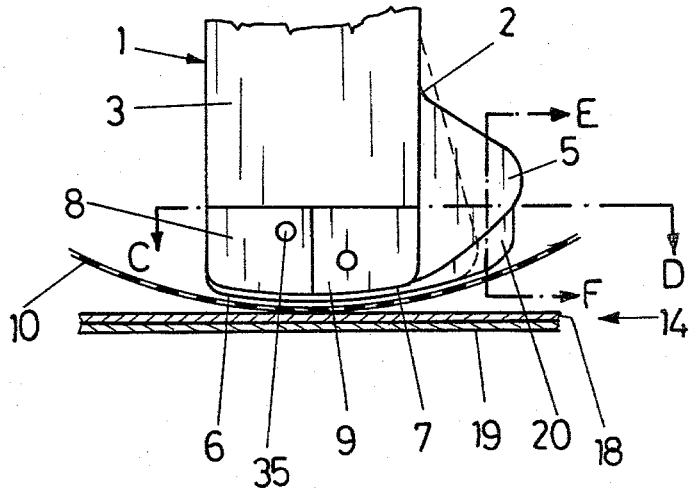
FIG. 4 illustrates a sectional side view of a further embodiment of the invention.
Figure 5:
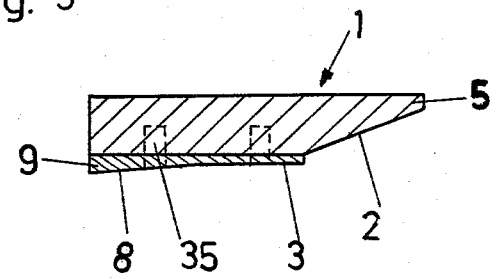
FIG. 5 is a partial sectional view on the line CD of FIG. 4.
Figure 6:
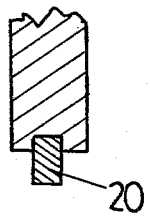
FIG. 6 is a partial sectional view on the line EF of FIG. 4.

The stop member according to FIG. 4, has a shoulder 5 projecting outwardly in the form of a bevelled surface of that area which comes into contact with the ink 13.

The embodiment according to FIG. 4 illustrates a further feature, namely a strip 20 of foam rubber, which is attached to the bottom of sealing plate 1, enabling the use of a certain type of sealing plate 1 in connection with differently curved rotary screens. This material reduces the size of gap 6 when screens with a slight curvature are used, and a strip on the support has no disadvantage when using heavily curved screens.

Blind holds 35 are provided in two sealing plates 1 lying opposite each other, this enables the insertion of a squeegee blade carrier of a known design in two positions according to the printing requirements.

Figure 7:
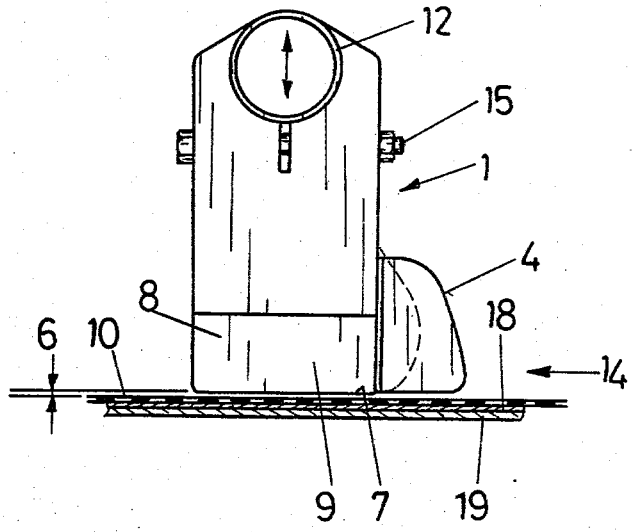
FIG. 7 illustrates the use of the device according to the invention for flat screen printing.

FIG. 7 illustrates a stop member which partly embraces the holding rod 12. The sealing plate 1 is attached vertically to the axis of the holding rod 12 and has an inwardly pointing surface 8 for the guidance of a squeegee roller, which surface is formed on a plate 9 of hard metal as in the previous embodiment.

Figure 8:
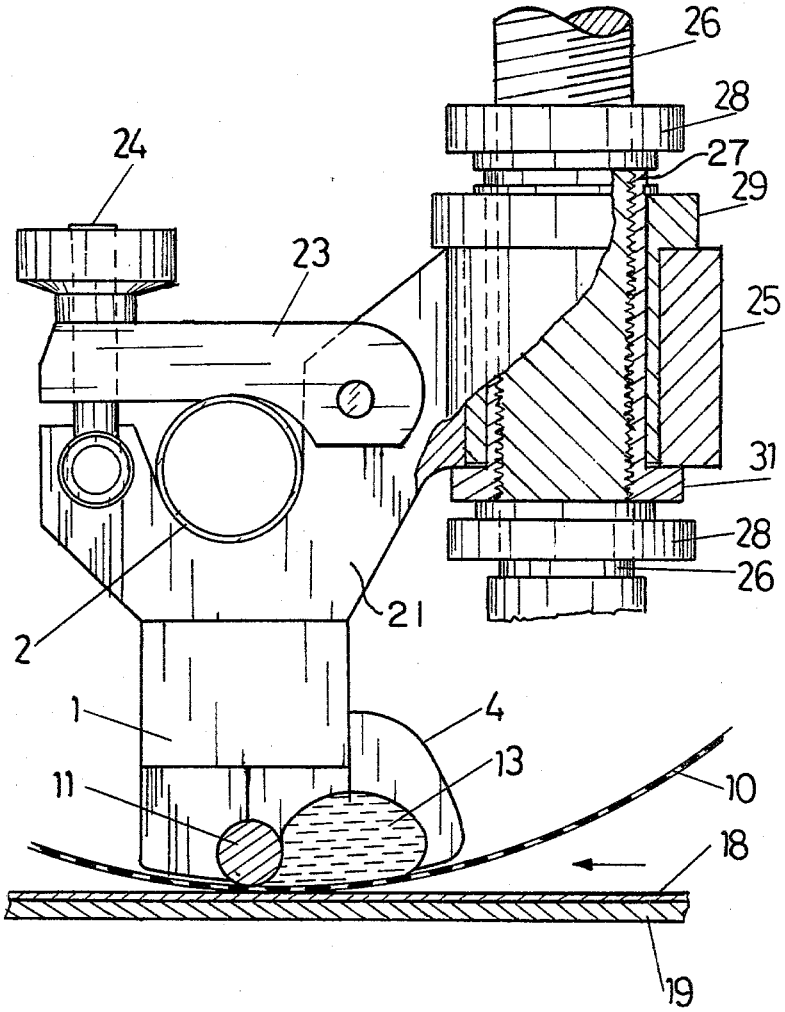
FIG. 8 is a detailed side view of an adjusting device for the traversing stops according to the invention.
Figure 9:
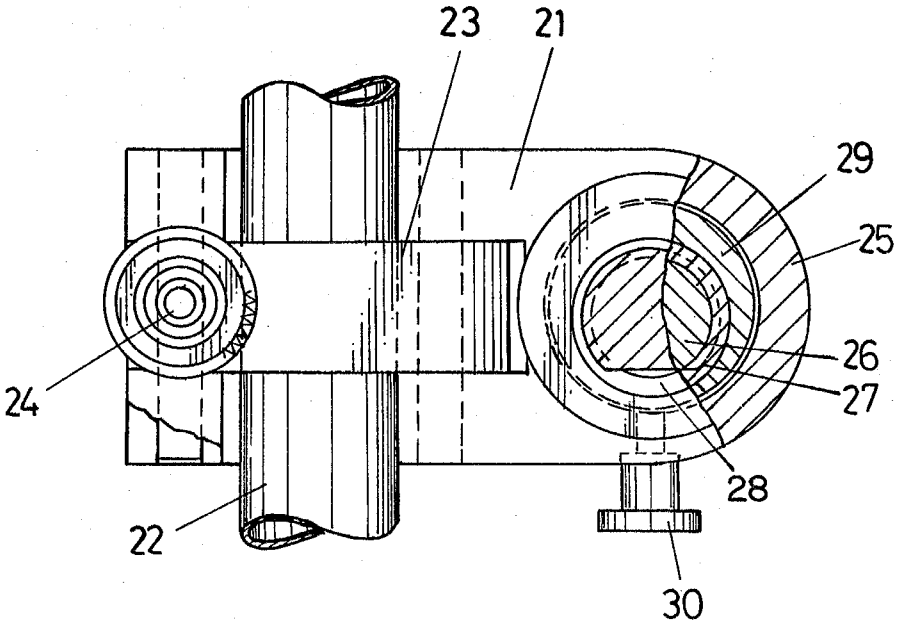
FIG. 9 is a vertical section in detail of that shown in FIG. 8.

The clamping and adjusting device according to FIGS. 8 and 9 is located at both sides of a rotary screen 10, FIG. 8 being a side view of the rotary screen device.

A vertical guide rod 26 having a thread is mounted to the machine support. A supporting shell 21 with a collar 25 is positioned on the guide rod 26 and the shell may be vertically adjusted by a threaded sleeve connected to the guide rod. The relative position is maintained by two screw nuts 28 which lock the threaded sleeve 27. Obviously other types of well known adjusting devices can be employed.

For simple interchangeability of the ink feeding pipe and the squeegee carrying tube 12, a clamping bracket 23 can be swivelled over the supporting shell 21, which clamping bracket is tightened by means of a clamping screw 24 which may also be swivelled.

Collar 25 of supporting shell 21 is axially movable on the guide rod 26 by a threaded sleeve 27. As diagonal movement of the blade of the squeegee may occur during the operation or assembly of the squeegee device, a movable member 29 is positioned between the threaded sleeve 27 and the collar 25.

By means of the torsion generated by member 29, horizontal thrust of the clamping device occurs, whereby an accurate parallel alignment of the squeegee with the contact line of the screen is obtained.

Any unintentional torsion of the member 29 is prevented by the knurled-head screw 30, which radially clamps the member 29.

Many modifications and variations of the present invention are possible in light of the above teachings. It is, therefore, to be understood that within the scope of the appended claims, the invention may be practiced otherwise than as particularly described.

What is claimed is:

1. An apparatus for treating advancing sheet material with a pool of liquid substance in a controlled manner, said apparatus comprising: a perforated screen, a rolling squeegee for the application of said substance onto said material through cooperation with said screen; sealing plate means being adjustably disposed above said screen for cooperation with said squeegee, said sealing plate means having side plate members adapted to be positioned with respect to said squeegee for laterally limiting the pool of said substance; and sealing plate means further comprising at least one-wall portion inclined with respect to one direction of travel of said material with respect to said squeegee, said sealing plate means being adjustably mounted by support means and a bottom surface of said sealing plate means being in a portion of said pool, spaced from said screen to form an adjustable gap between the bottom surface of said sealing plate means and said screen.

2. An apparatus as claimed in claim 1 wherein a flap means is hingedly connected to said plate means, said flap forms a variable angle with respect to said one direction of travel of said material.

3. An apparatus as claimed in claim 1 wherein: said plate means being formed to extend beyond the width of said squeegee.

4. An apparatus as claimed in claim 1 wherein: one side wall portion of the sealing plate has a supporting plate of friction-resistant hard material for the axial guidance of a roller squeegee.

5. An apparatus as claimed in claim 1 wherein said sealing plate means being connected to holding rod means for feeding said liquid substances therethrough, said holding rod means being disposed in said support means and fixed by a clamping bracket tightened by a clamping means.

6. An apparatus as claimed in claim 5, wherein: the support means is positioned on a vertical guide rod and is axially movable.

7. An apparatus as claimed in claim 1 wherein: a strip of foam rubber being fixed to said bottom surface of said sealing plate means, which strip fills up at least part of a gap formed between said sealing plate means and said screen.

8. An apparatus as claimed in claim 1 wherein: said sealing plate means being provided with at least one recess for mounting said squeegee.

* * * * *